US006691605B2

(12) United States Patent
Röllgårdh

(10) Patent No.: US 6,691,605 B2
(45) Date of Patent: Feb. 17, 2004

(54) PISTON-CYLINDER DEVICE WITH AT LEAST ONE POSITION INDICATING SENSOR

(75) Inventor: Folke Lennart Röllgårdh, Dannike (SE)

(73) Assignee: Parker Hannifin AB, Boras (SE)

( * ) Notice: Subject to any disclaimer, the term of this patent is extended or adjusted under 35 U.S.C. 154(b) by 5 days.

(21) Appl. No.: 10/189,064

(22) Filed: Jul. 3, 2002

(65) Prior Publication Data

US 2003/0010192 A1 Jan. 16, 2003

(30) Foreign Application Priority Data

Jul. 6, 2001 (SE) ..... 0102427

(51) Int. Cl.[7] ..... F01B 25/26
(52) U.S. Cl. ..... 92/5 R; 91/1
(58) Field of Search ..... 92/5 R; 91/1

(56) References Cited

U.S. PATENT DOCUMENTS 6,427,576 B1 * 8/2002 Bock et al. ..... 92/5 R

* cited by examiner

*Primary Examiner*—Edward K. Look
*Assistant Examiner*—Michael Leslie
(74) *Attorney, Agent, or Firm*—Frishauf, Holtz, Goodman & Chick, P.C.

(57) ABSTRACT

A pressure medium actuated piston-cylinder device comprises at least one magnetically activated sensor (20) for detecting the piston position and which is adjustably attached to the cylinder (10) for indicating, both optically and electrically any desired piston position, wherein the sensor or sensors (20) are mounted in at least one longitudinal channel (17) on the outside of the cylinder (10), and one or more clamping spindles (21) are rotatively supported in and extending throughout the length of the channels (17) and arranged to be rotatively shifted by an activating mechanism (23) between a sensor (20) arresting position and a sensor (20) releasing position.

18 Claims, 3 Drawing Sheets

PISTON-CYLINDER DEVICE WITH AT LEAST ONE POSITION INDICATING SENSOR

The invention relates to a pressure medium actuated piston-cylinder device of the type having at least one magnetically activated position detecting sensor adjustably attached to the cylinder for indicating, both optically and electrically, any desired piston position.

In previous piston-cylinder devices of the above type, the position sensors and their clamping means have simply been mounted on the outside of the cylinder mantle, for instance in longitudinal channels in the mantle. This has caused not only a damage risks for the sensors themselves and their wiring, but a difficulty to keep the exterior of the cylinder clean, which is a necessity in for instance the food industry.

The main object of the invention is to create a piston-cylinder device provided with at least one easily adjustable position sensor and having a smooth exterior for facilitating cleaning of the device.

Another object of the invention is to create a piston-cylinder device where the position sensor or sensors are well protected against mechanical damage but still easily adjustable and arrestable in desired positions and visible for optical position indication.

Further objects and advantages will appear from the following specification and claims.

A preferred embodiment of the invention is described below with reference to the accompanying drawings.

Figure 1:
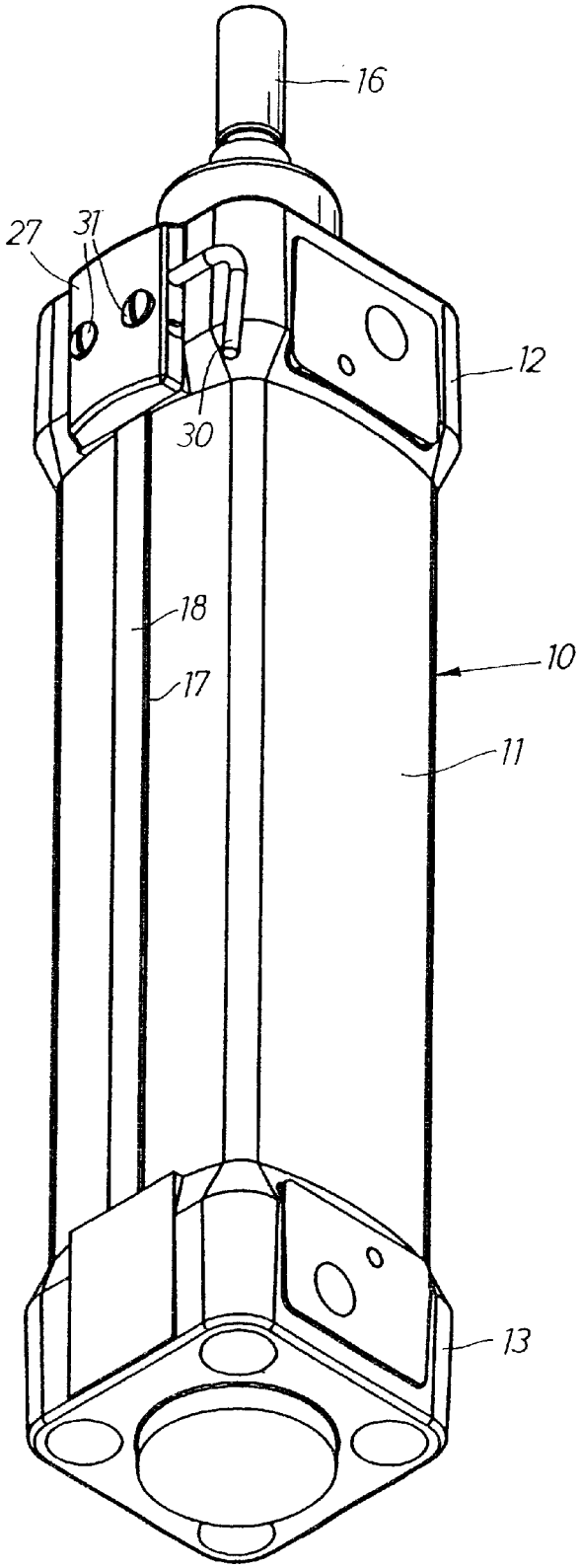
FIG. 1 shows a side view of a piston-cylinder device according to the invention.
Figure 2:
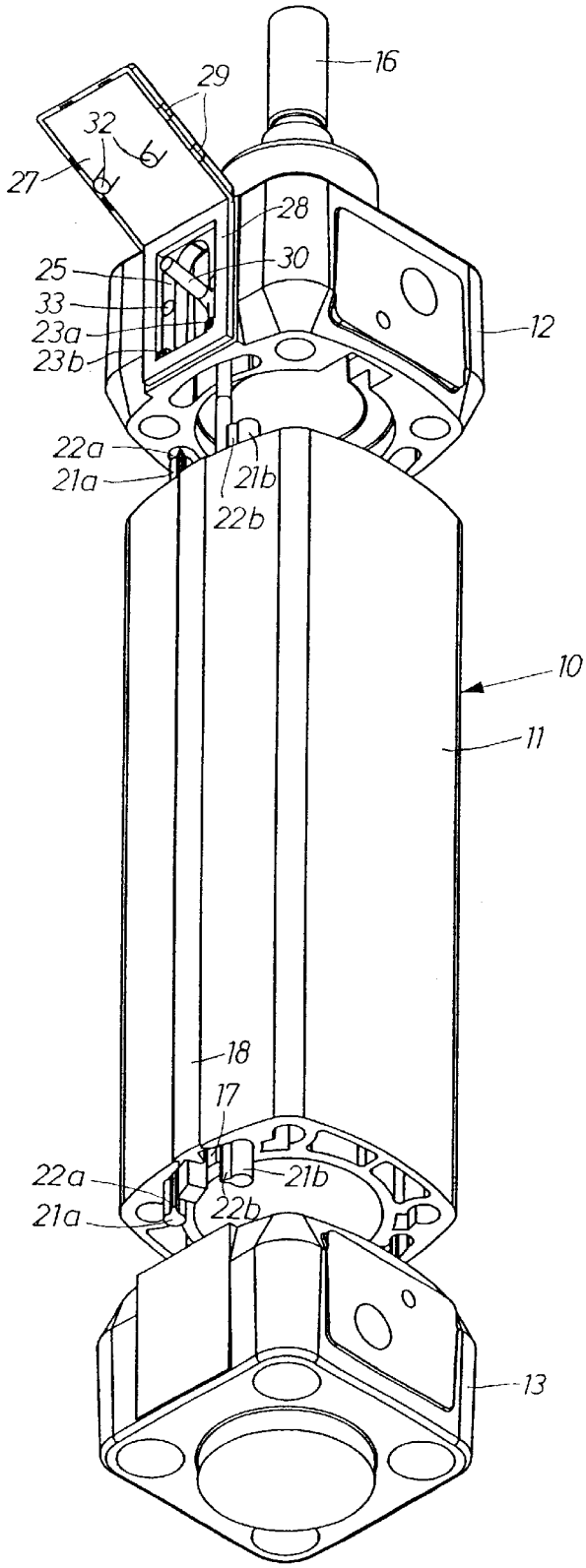
FIG. 2 shows a perspective view of the device in FIG. 1 with the end pieces separated from the cylinder mantle and with the protective lid in open position.

The piston-cylinder device illustrated in drawings is in fact a pneumatic actuator cylinder 10 comprising a cylinder with an elongate mantle 11, two opposite end pieces 12,13, and a piston unit including a pressure activated piston (not shown) movably guided in the cylinder mantle 11, and a piston rod 16 connected to the piston and extending out of the cylinder 10 through the end piece 12 for connection to an external object to be actuated.

The cylinder mantle 11 is provided with an axially extending external channel 17 which is closed by a transparent plastic wall element 18, and which is arranged to receive one or more position sensors 20*a*, 20*b*. In a conventional way, the sensors 20*a*, 20*b* are activated by the magnetic field of a permanent magnet (not shown) mounted on the piston, which means that each sensor 20 generates an electrical signal as the piston with its magnet passes the sensor 20 at the inside of the cylinder mantle 11. The sensors 20 may vary in number from one to several, depending on how much information you want to obtain regarding the piston movements in the cylinder 10. Each sensor 20 is provided with a wiring (not shown) which is connected to a separate control unit and which is also used for inserting the sensor 20 into the channel 17 and locating it to its proper position.

Figure 3:
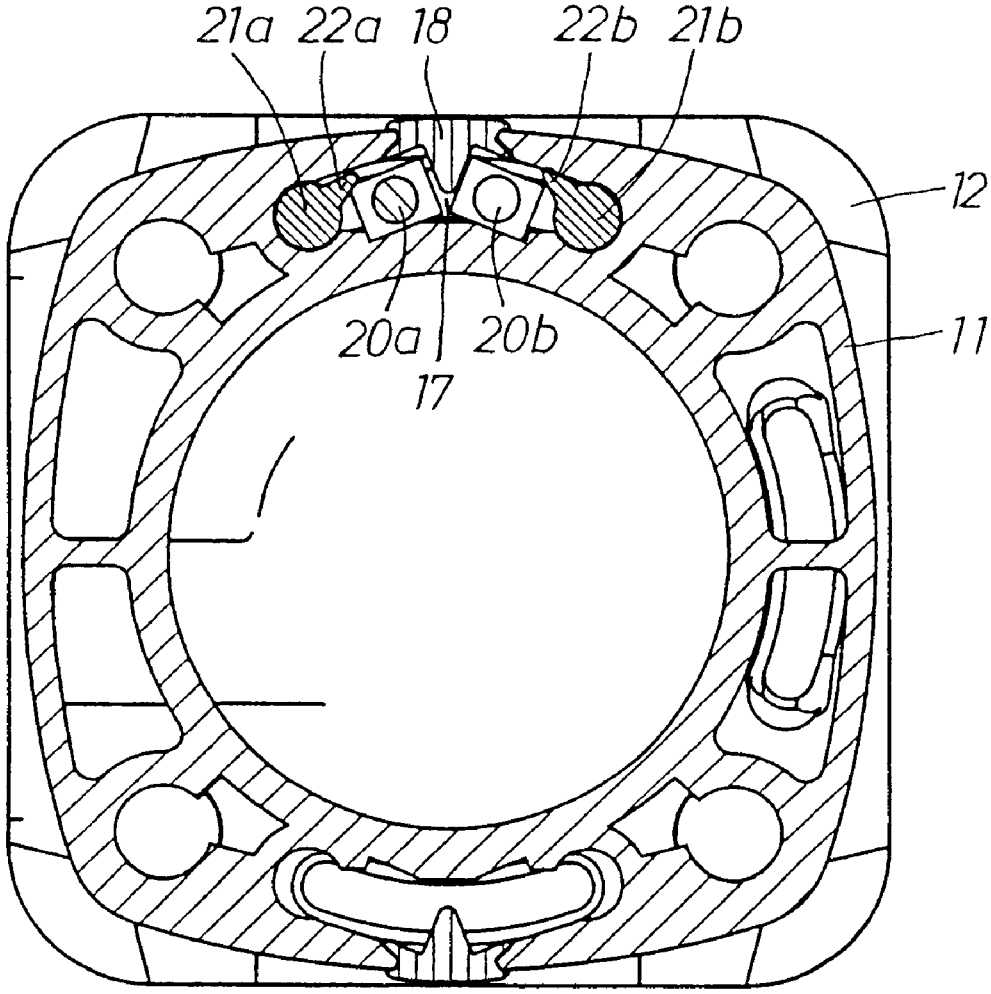
FIG. 3 shows, on a larger scale, a cross section through the cylinder.

The channel 17 is T-shaped to give room for two rows of sensors 20*a*, 20*b*. Within the channel 17 there are also supported two clamping spindles 21*a*, 21*b* which are parallel to each other and arranged to engage and arrest all sensors 20*a*, 20*b* in the adjacent rows. For this purpose the clamping spindles 21*a*, 21*b* are formed with cam surfaces 22*a*, 22*b* which are intended to engage and clamp the sensors 20*a*, 20*b* when the spindles 21*a*, 21*b* are rotated. See FIG. 3.

At one end of the clamping spindles 21*a* 21*b* there are provided actuating mechanisms by which the spindles 21*a*, 21*b* are rotatively shiftable between a clamping position and a releasing position. The actuating mechanisms comprise manuever screws 23*a*, 23*b* accessible from outside the cylinder 10.

Each sensor 20 used for this purpose includes a light emitting means, such as a LED element, and when the sensor 20 is activated the LED element will emit an optical signal in parallel with the electrical signal delivered via the wiring. The optical signal emitted by the LED element is visually detected through the transparent elongate wall element 18 inserted in the channel 17. If a number of sensors are used, it is preferable to use sensors with LED elements emitting light of different colours to facilitate distinction of the different piston positions.

In one of the end pieces 12 there is provided a lateral opening 25 through which the sensors 20*a*, 20*b* are insertable into the channel 17, and adjacent the opening 25 there are located the maneuver screws 23 of the clamping spindle 21 actuating mechanisms. A protective lid 27 is arranged to cover the opening 25 as well as the heads of the maneuver screws 23, and a soft elastic seal 28 is mounted around the opening 25 to co-operate with the lid 27 and seal off the interior of the channel 17 and protect the maneuver screws 23. At one of its edges the lid 27 is provided with recesses 29 for passing of the wiring 30 connected to the sensors 20*a*, 20*b*. Two screws 31 are intended to penetrate two holes 32 in the lid 27 and engage two threaded bores 33 in the end piece 12 for securing the lid 27 in closed position.

When the sensors 20*a*, 20*b* are inserted through the opening 25 and properly located and arrested by the clamping spindles 21*a*, 21*b* in the channel 17 and the lid 27 is closed and secured to the end piece 12, the cylinder 10 is properly equipped with position sensors which are visible from outside, well protected against mechanical damage and leaving a generally smooth exterior of the cylinder 10 which is easy to keep clean.

In the above described example, the device comprises a piston unit with a piston rod 16 extending out of the cylinder for connection to an external object. The invention, however, is not limited to this particular type of piston-cylinder device but may very well be used at a device having an actuator piston connected to a flexible element like a steel band or chain extending out of the cylinder through both end pieces for connection to external objects.

What is claimed is:

1. Pressure medium actuated piston-cylinder device, comprising a cylinder (10) with a mantle (11) and two end pieces (12,13), a piston unit axially movable relative to the cylinder (10), and at least one magnetically activated position sensor (20) arrestable to the cylinder (10) in any desired axial position for indicating the piston unit position relative to the cylinder (10), characterized in that the cylinder mantle (11) is provided on its outside with at least one axially extending channel (17) for displaceably receiving said at least one sensor (20), one or more clamping spindles (21) rotatively supported in and extending throughout the length of said channel (17), and an activating mechanism (23) for rotatively shifting said clamping spindle (21) between a sensor arresting position and a sensor releasing position.

2. Piston-cylinder device according to claim 1, wherein said clamping spindle (21) comprises an elongate cam surface (22) extending throughout the length of the clamping spindle (21) and arranged to engage said at least one sensor (20) in said arresting position.

3. Piston-cylinder device according to claim 2, wherein said at least one sensor (20) comprises a light emitting means for optical indication of the piston position, wherein a transparent elongate wall element (18) is inserted in said channel (17) to close the same and enable light emitted by said at least one sensor (20) to be detected from outside the cylinder (10).

4. Piston-cylinder device according to claim 3, wherein one of said end pieces (12) is provided with a lateral opening (25) through which said channel (17) is accessible for insertion of said at least one sensor (20) in said channel (17), said each sensor (20) is put in place in said channel (17) by means of the wiring connected to the sensor (20).

5. Piston-cylinder device according to claim 4, wherein each activating mechanism (23) comprises a maneuver screw (23) located adjacent said lateral opening (25), and a lid (27) mounted on said end piece (12) is arranged to cover said opening (25) and the maneuver screw (23) of each activating mechanism.

6. Piston-cylinder device according to claim 2, wherein said channel (17) is adapted to receive two or more sensors (20*a*,20*b*) in two parallel rows, as well as two parallel clamping spindles (21*a*,21*b*), each one of said clamping spindles (21*a*,21*b*) is arranged to arrest the sensor or sensors (20*a*,20*b*) in one of said rows and is controlled by a separate activating mechanism (23*a*,23*b*).

7. Piston-cylinder device according to claim 6, wherein one of said end pieces (12) is provided with a lateral opening (25) through which said channel (17) is accessible for insertion of said at least one sensor (20) in said channel (17), said each sensor (20) is put in place in said channel (17) by means of the wiring connected to the sensor (20).

8. Piston-cylinder device according to claim 7, wherein each activating mechanism (23) comprises a maneuver screw (23) located adjacent said lateral opening (25), and a lid (27) mounted on said end piece (12) is arranged to cover said opening (25) and the maneuver screw (23) of each activating mechanism.

9. Piston-cylinder device according to claim 2, wherein one of said end pieces (12) is provided with a lateral opening (25) through which said channel (17) is accessible for insertion of said at least one sensor (20) in said channel (17), said each sensor (20) is put in place in said channel (17) by means of the wiring connected to the sensor (20).

10. Piston-cylinder device according to claim 9, wherein each activating mechanism (23) comprises a maneuver screw (23) located adjacent said lateral opening (25), and a lid (27) mounted on said end piece (12) is arranged to cover said opening (25) and the maneuver screw (23) of each activating mechanism.

11. Piston-cylinder device according to claim 1, wherein said at least one sensor (20) comprises a light emitting means for optical indication of the piston position, wherein a transparent elongate wall element (18) is inserted in said channel (17) to close the same and enable light emitted by said at least one sensor (20) to be detected from outside the cylinder (10).

12. Piston-cylinder device according to claim 11, wherein one of said end pieces (12) is provided with a lateral opening (25) through which said channel (17) is accessible for insertion of said at least one sensor (20) in said channel (17), said each sensor (20) is put in place in said channel (17) by means of the wiring connected to the sensor (20).

13. Piston-cylinder device according to claim 12, wherein each activating mechanism (23) comprises a maneuver screw (23) located adjacent said lateral opening (25), and a lid (27) mounted on said end piece (12) is arranged to cover said opening (25) and the maneuver screw (23) of each activating mechanism.

14. Piston-cylinder device according to claim 1, wherein said channel (17) is adapted to receive two or more sensors (20*a*,20*b*) in two parallel rows, as well as two parallel clamping spindles (21*a*,21*b*), each one of said clamping spindles (21*a*,21*b*) is arranged to arrest the sensor or sensors (20*a*,20*b*) in one of said rows and is controlled by a separate activating mechanism (23*a*,23*b*).

15. Piston-cylinder device according to claim 14, wherein one of said end pieces (12) is provided with a lateral opening (25) through which said channel (17) is accessible for insertion of said at least one sensor (20) in said channel (17), said each sensor (20) is put in place in said channel (17) by means of the wiring connected to the sensor (20).

16. Piston-cylinder device according to claim 15, wherein each activating mechanism (23) comprises a maneuver screw (23) located adjacent said lateral opening (25), and a lid (27) mounted on said end piece (12) is arranged to cover said opening (25) and the maneuver screw (23) of each activating mechanism.

17. Piston-cylinder device according to claim 1, wherein one of said end pieces (12) is provided with a lateral opening (25) through which said channel (17) is accessible for insertion of said at least one sensor (20) in said channel (17), said each sensor (20) is put in place in said channel (17) by means of the wiring connected to the sensor (20).

18. Piston-cylinder device according to claim 17, wherein each activating mechanism (23) comprises a maneuver screw (23) located adjacent said lateral opening (25), and a lid (27) mounted on said end piece (12) is arranged to cover said opening (25) and the maneuver screw (23) of each activating mechanism.

* * * * *